US005540609A

United States Patent [19]

Hoag

[11] Patent Number: 5,540,609

[45] Date of Patent: Jul. 30, 1996

[54] STORY QUILT AND ASSOCIATED SET OF DOLLS

[76] Inventor: Barbara J. Hoag, 1347 Valley Home Rd., Dandridge, Tenn. 37725

[21] Appl. No.: 440,747

[22] Filed: May 15, 1995

[51] Int. Cl.[6] ..... A63H 33/00; A63H 3/00; A63H 3/02

[52] U.S. Cl. ..... 446/26; 446/73; 446/369; 446/901; 5/485; 5/502; 5/907

[58] Field of Search ..... 446/26, 27, 28, 446/74, 73, 72, 369, 901, 478; 5/420, 485, 502, 907

[56] References Cited

U.S. PATENT DOCUMENTS

| | | | |
|---|---|---|---|
| 4,435,915 | 3/1984 | Zaruba et al. | 446/478 X |
| 4,543,278 | 9/1985 | Ackerman . | |
| 4,853,994 | 8/1989 | Ekstein . | |
| 4,874,340 | 10/1989 | Smallwood . | |
| 4,979,921 | 12/1990 | Cardillo | 446/28 X |
| 4,993,987 | 2/1991 | Hull et al. . | |
| 5,009,626 | 4/1991 | Katz . | |
| 5,118,318 | 6/1992 | Lorizio | 446/72 |
| 5,136,726 | 8/1992 | Kellin et al. | 446/901 X |
| 5,299,968 | 4/1994 | Bennett | 446/901 X |
| 5,332,093 | 7/1994 | Littlepage . | |
| 5,340,348 | 8/1994 | Schroeder . | |
| 5,344,356 | 9/1994 | Pizzelli et al. . | |

*Primary Examiner*—Mickey Yu

*Assistant Examiner*—D. Neal Muir

*Attorney, Agent, or Firm*—Pitts & Brittian, P.C.

[57] ABSTRACT

A story quilt and associated set of dolls (10) for being secured to a wall, with the associated set of dolls (26) being individually and releasably secured thereto. A plurality of loop members (14) are provided along the top border to enable the securement of the story quilt (12) to a wall. The front panel (15) of the story quilt (12) is sectioned into a grid of individual panels (16). Each panel (16) illustrates a particular scene, in similar fashion to a conventional story board. Each of the individual panels (16) is decorated to reflect the personality of the particular doll (26) to be secured to that panel (16) and is provided with a conventional fastener (18) for the securement of the doll (26). A pocket (17) is carried by selected of the individual panels (16) for storing various selected items. One individual panel (16) may be provided with a pocket (20) for carrying a story book (24) illustrating at least one story involving the characters of the dolls (26) carried on the individual panels (16). Other individual panels (16) may be provided as decorative panels. The cooperating fastener (32) is secured to the back of the doll (26). A wristband (38) is provided for the securement of one of the dolls (26) to a person's wrist or ankle. A cooperating fastener (52) is provided on the top side (40) of the wristband (38) to cooperate with the fastener (32) carried by the doll (26). The dolls (26) are soft sculpture dolls having faces and other features constructed using embroidery techniques controlled by a computer.

7 Claims, 5 Drawing Sheets

STORY QUILT AND ASSOCIATED SET OF DOLLS

TECHNICAL FIELD

This invention relates to the field of toys and amusement devices, and a method for manufacturing the same. Specifically, this invention relates to a story quilt and an associated set of dolls.

BACKGROUND ART

In the field of toys and amusement devices, it is well known that dolls of various kinds have been made in the image of humans and animals for centuries. It is known that in ancient history, dolls were carved from stone and wood. More recently, dolls have been made from anything from corn husks, plastics, rags, or other available materials. Dolls have been made and used as personifications of humans and animals especially for children to play with in their developmental stages of life. Of late, a growing interest is to manufacture dolls which create as little risk to the child as possible. This concern is a result of safety hazards that have been the cause many serious and sometimes fatal injuries. However, in achieving this goal, it is also essential that the dolls retain the similarity of humans and animals. It is also a goal of the toy industry to create dolls which provide long-term amusement potential by providing various settings in which the dolls may be used.

Porcelain dolls and carved painted dolls have long been the most clearly representative of human or animal form and detail. However, these dolls are fragile and therefore create potential hazards to children in the event the doll is broken while the child is playing with the same. Because of their potential dangers, these dolls have been held more as keepsakes than as toys. More recently, dolls manufactured from rigid or semi-rigid plastics present similar concerns to those of older wooden dolls. Specifically, these dolls present potential hazards when a child is impacted if such a doll is thrown, or if the child is carrying the doll and falls. To overcome these hazards, many dolls have been manufactured from soft materials, but have facial features attached thereto. These features, due to their small size and removability, have presented problems with choking when they become detached from the doll and are accidentally swallowed. Soft sculpture dolls have otherwise been limited in the extent of facial expression due to their methods of manufacture.

It is well known that children play with dolls with many different media. Further, dolls are provided with many different means for storing and carrying dolls. Typical of the art are those dolls disclosed in the following U.S. Pat. Nos.:

| U.S. Pat. No. | Inventor(s) | Issue Date |
|---|---|---|
| 4,543,278 | G. K. Ackerman | Sept. 24, 1985 |
| 4,853,994 | P. S. Ekstein | Aug. 8, 1989 |
| 4,874,340 | A. R. Smallwood | Oct. 17, 1989 |
| 4,993,987 | H. L. Hull, et al. | Feb. 19, 1991 |
| 5,009,626 | M. M. Katz | Apr. 23, 1991 |
| 5,118,318 | R. J. Lorizio | June 2, 1992 |
| 5,332,093 | F. Littlepage | July 26, 1994 |
| 5,340,348 | E. J. Schroeder | Aug. 23, 1994 |
| 5,344,356 | D. A. Pizzelli, et al. | Sept. 6, 1994 |

Of these, Ackerman ('278) discloses a wall-mourned board for removably storing children's toys using conventional hook-and-loop fasteners. The board presents hazards due to its rigid construction in the event that it becomes detached from the wall. Further, one portion of the hook-and-loop fastener must be secured to any toy to be stored thereon. The board serves no other function than to hold the toys, it is not necessarily used as a theme for the toys, or as a medium for playing with the toys.

Ekstein ('994) discloses a pillow book having pockets provided on individual "pages" of the book. The pockets are provided for receiving character dolls used in telling the story portrayed in the pillow book. Only the portion of the story book that is opened may be used at any given time, as the remainder is closed within the book.

Smallwood ('340) provides a device similar to that disclosed by Ekstein ('994) with the exception that a stuffed toy is permanently affixed to the exterior of the story book. Clothing is removably secured to the toy and is placed within a pocket on the inside of the book when not secured to the toy.

Lorizio ('318) discloses a pillow cover which includes a pictorial representation of a character and provides storage for dolls in the form of pockets secured to the pillow cover via conventional hook-and-loop fasteners or snaps. Suction cups are carried by each doll for securement to a flat, smooth surface. The pillow cover serves both as a carrier for the dolls and as a medium for playing with the dolls. The background illustrated on the pillow cover is appropriately chosen to coordinate with the particular toys secured thereto. However, when used for its intended purpose of supporting a child's head while sleeping, the toys must be typically be removed from the pillow cover in order to reduce safety hazards or otherwise to aid in the comfort of the sleeping child.

Littlepage ('093) discloses a doll and storage container. The storage container may also be used as a carrying device. The storage container is provided with a plurality of pockets for carrying doll accessories and a hook-and-loop strap for securing the doll. The storage container is closed using hook-and-loop fasteners. The storage container is configured to simulate a mail receptacle, but is not otherwise used in playing with the doll.

Schroeder ('348) discloses a doll having a hook-and-loop fastener for releasably securing an object thereto. For example, an appropriately-sized toy basketball is releasably secured to the hand of a toy basketball player. The toy is stored in a box which is not provided for interactive play with the doll itself.

The device disclosed by Pizzelli, et al. ('356) is a storage unit having attachable holders. In similar fashion to the Ackerman ('278) device discussed above, the Pizzelli, et al., device is used to secure various items thereto, the items and the device not being necessarily related in theme. The '356 device is provided as an organizational device for storing items such as those associated with a person's hair (hair bows, combs, etc.).

Hull, et al. ('987), and Katz ('626) disclose methods for manufacturing dolls to emulate lifelike features. Hull, et al., teach the photographic application of a person's face on a fabric doll. Katz discloses a method for applying a three-dimensional lifelike representation of the head portion of a real life subject to a substrate structure of configuration and size matched to the real life subject. However, either of these methods presents a device or method for storing or carrying such dolls. Further, these devices rely upon a printed face on the dolls. Such do not disclose a method for embroidering a face onto a doll.

None of the prior art references disclose a device for storing the dolls while also providing a medium of interaction with the dolls and the child. Further, none of the prior art references teaches a device for storing a plurality of dolls in a manner that does not endanger a child while also not requiring storage space other than wall space.

Therefore, it is an object of this invention to provide a means for storing a plurality of dolls.

It is also an object of the present invention to provide such a storage device which may also be used as an interactive tool for playing with the dolls.

Another object of the present invention is to provide a means for carrying the dolls an a child's person when not being used in association with the storage device.

Still another object of the present invention is to provide such a storage device for storing the dolls which is further provided with a means for storing the carrying means provided for carrying the dolls on a child's person.

A further object of the present invention is to provide a method for manufacturing dolls such that there is no danger presented to the child using the same.

Still another object of the present invention is to provide such a method of manufacturing soft sculpture dolls whereby realistic features are accomplished.

A further object of the present invention is to provide such a method of manufacturing dolls whereby embroidery is used to emulate facial features and other features such as clothing and decorative items associated with conventional clothing.

DISCLOSURE OF THE INVENTION

Other objects and advantages will be accomplished by the present invention provides a story quilt designed for being secured to a wall, with an associated set of dolls being individually and releasably secured thereto. Moreover, in the preferred embodiment the story quilt is designed to store wristbands upon which may be secured the dolls for transporting the same. The dolls are designed to be safely usable by children while providing lifelike characteristics of humans or animals.

The story quilt of the present invention is fabricated in a manner similar to a conventional quilt. A plurality of loop members are provided along the top border to enable the securement of the story quilt to a wall. The front panel of the story quilt is sectioned into a grid of individual panels. Each panel illustrates a particular scene, in similar fashion to a conventional story board. Each of the individual panels is decorated to reflect the personality of the particular doll to be secured to that panel and is provided with a conventional fastener for the securement of the doll. A pocket is also secured to the individual panels for storing various selected items. One individual panel may be provided with a pocket for carrying a story book illustrating at least one story involving the characters of the dolls carried on the individual panels. Other individual panels may be provided as decorative panels. The cooperating portion of the fastener is secured to the back of the doll.

A wristband is provided for the securement of one of the dolls to a person's wrist or ankle. The wristband is comprised of a length of elastomeric material such as a conventional elastic strip. One portion of a fastener is carried by the proximal end of the top side of the elastic strip while the cooperating portion of the fastener is carried by the distal end of the bottom side of the elastic strip. The cooperating portions are engaged when the elastic strip is placed around a person's wrist or ankle. A cooperating portion of a fastener is further provided on the top side of the elastic strip to cooperate with the portion of the fastener carried by the doll.

The dolls are fabricated such that they may be safely used by children. To this extent, the dolls are soft sculpture dolls such that any impact with a child is substantially harmless. The faces and other features of the dolls and their apparel are constructed using embroidery techniques controlled by a computer. The input of the design is performed one color at a time. Specifically, a face and head may be input in six layers if six thread colors are required. These layers may include: (1) the face, excluding the individual features; (2) the eyes excluding the pupils; (3) the pupils of the eyes, the eyelashes, and the eye brows; (4) the lips and nostrils; (5) the hair on the front of the head; and (6) the hair on the back of the head. The design can be input in any conventional fashion such as by scanning, digitizing, or by simply creation within the computer via conventional graphics software. Once received within the processor, the data is stored for later retrieval as required. When the data is output to an embroidery machine, each of the layers are overlaid to compose the selected image.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
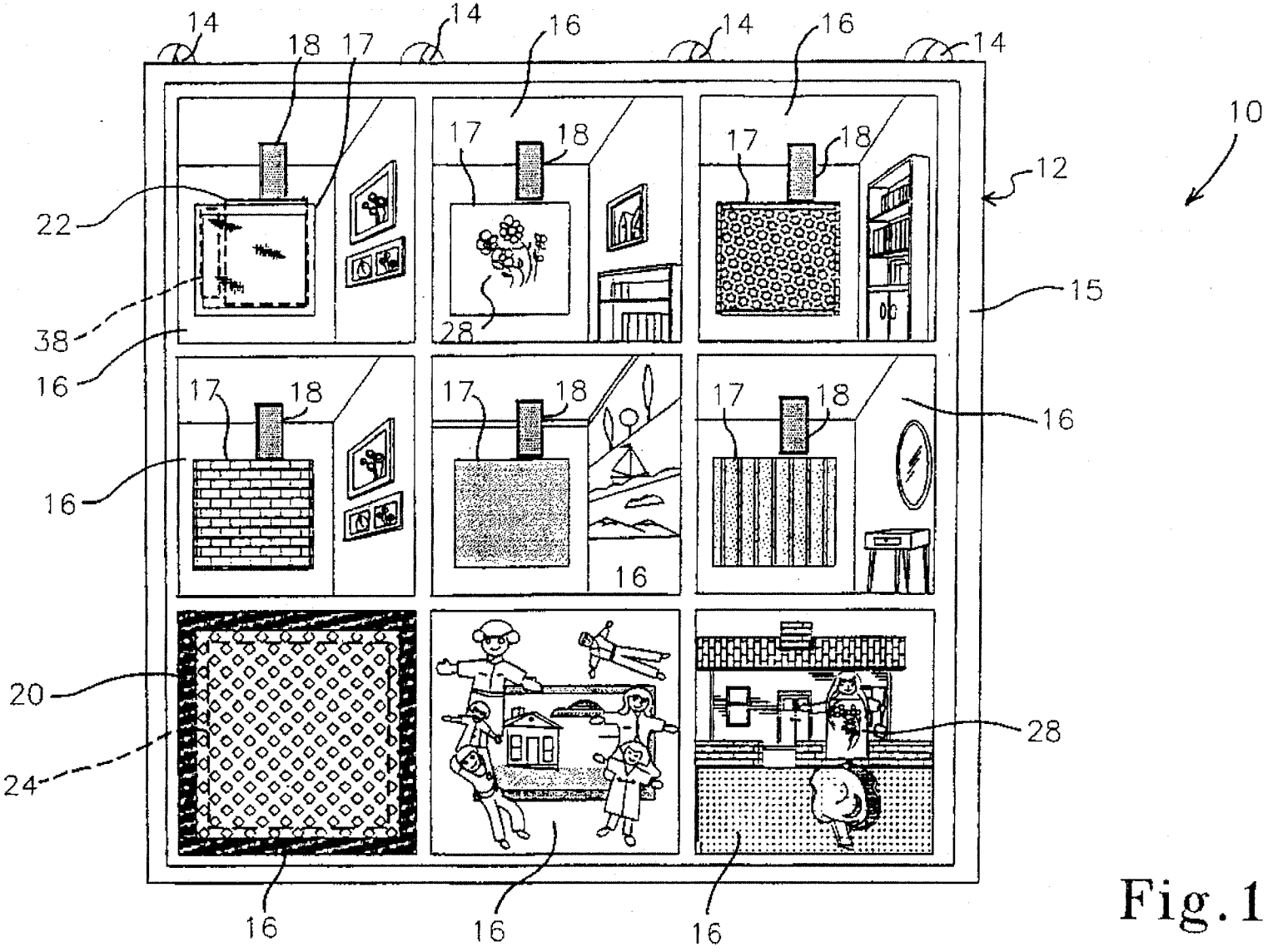
FIG. 1 is a front elevational view of the story quilt and one of an associated set of dolls being secured thereto, the story quilt and doll being constructed in accordance with several features of the present invention.

A story quilt and associated set of dolls incorporating various features of the present invention is illustrated generally at 10 in the figures. The story quilt 12 is designed for being secured to a wall, with the associated set of dolls 26 being individually and releasably secured thereto. Moreover, in the preferred embodiment the story quilt 12 is designed to store wristbands 38 upon which may be secured the dolls 26 for transporting the same. The dolls 26 are designed to be safely usable by children while providing lifelike characteristics of humans or animals.

The story quilt 12 of the present invention is fabricated in a manner similar to a conventional quilt. A plurality of loop members 14 are provided along the top border to enable the securement of the story quilt 12 to a wall. The loop members 14, in the preferred embodiment, are spaced equidistantly from each other such that when the story quilt 12 is hung from a wall, there will be minimal sagging.

The front panel of the story quilt 12 is sectioned into a grid of individual panels 16. Each panel 16 illustrates a particular scene, in similar fashion to a conventional story board. The illustrated embodiment of the front panel 15 is sectioned into a three-by-three grid of such individual panels 16. The top two rows of individual panels 16 each illustrate a particular room in a house, with each individual panel 16 having its own decor. Each of the individual panels 16 is decorated to reflect the personality of the particular doll to be secured to that panel 16. To this extent, each individual panel 16 is provided with a conventional fastener 18 for the securement of a doll 26 thereto. In the preferred embodiment, the fastener 18 is a hook-and-loop fastener, with the loop portion thereof being secured to the individual panel 16 and the cooperating hook portion 32 being secured to the doll 26. A pocket 17 is also secured to the individual panels 16 for storing various selected items. For example, printed matter 22 related to the particular doll 26, a wristband 38 for carrying the doll 26, or other related items may be stored within the pocket 17. The printed matter 22 may include a birth certificate, a biographical sketch of the character portrayed by the doll 26, or any other identification material.

In the illustrated embodiment, the bottom left individual panel 16 is provided with a pocket 20 for carrying a story book 24. The story book 24 of the preferred embodiment illustrates at least one story involving the characters of the dolls 26 carried on the individual panels 16 of the top two rows. The remaining two panels 16 are illustrated as being decorative panels 16, with nothing being received therein or secured thereto. For example, in the central panel 16 of the bottom row, a house is illustrated to reflect the house in which the characters of the dolls 26 live, i.e., the house in which the rooms illustrated in the top two rows are found. The last panel 16, in the bottom right corner, illustrates a garden behind the house.

Although nine individual panels 16 are illustrated in a three-by-three grid, with a particular arrangement of individual panels 16, pockets 17, and fasteners 18, it will be understood that more or fewer individual panels 16 may be provided. Further, the individual panels 16 may be disposed in a grid pattern, or in other than a grid pattern. Each individual panel 16 may be independently defined with a fastener 18, a pocket 17, or purely decorative items. It will be understood that each individual panel 16 is defined as a scene in a story such that all of the individual panels 16 combine to initiate a story line involving the particular set of dolls 26 to be secured thereto. Therefore, it is not intended that the present invention be limited to a story quilt 12 having nine individual panels 16 in a three-by-three grid.

Figure 2:
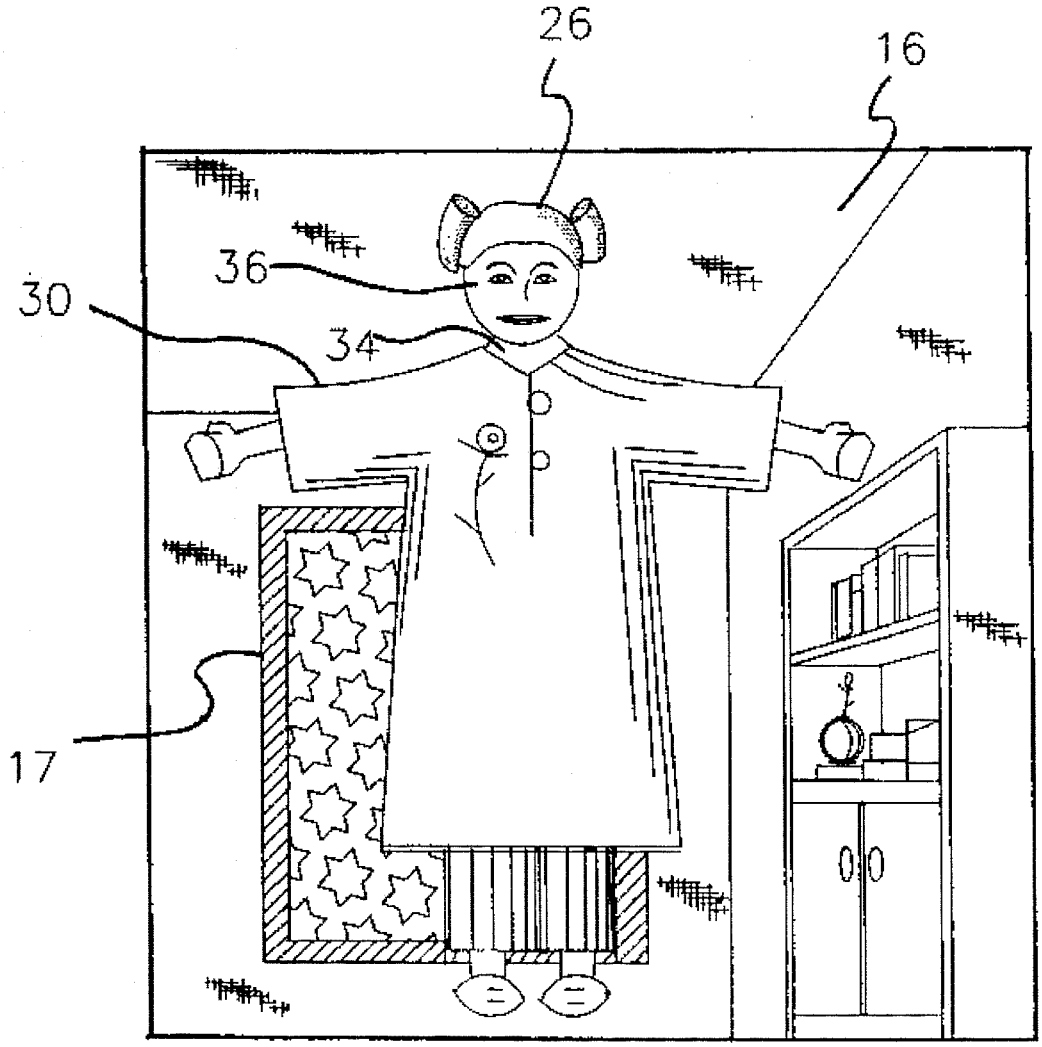
FIG. 2 illustrates a front elevational view of one panel of the story quilt illustrated in FIG. 1 showing a doll secured thereto.

Illustrated in FIG. 2 is an enlarged view of one of the individual panels 16 shown in FIG. 1. In this figure, a doll 26 is illustrated as being secured to the panel 16. The doll 26 and the individual panel 16 are each constructed to match the personality of the other. For example, the material of construction of the pocket 17 carried within the individual panel 16 may match an article of clothing worn by the doll 26. A decorative design 28 may also be common to the apparel of the doll 26 and something within the room, such as a decorative design 28 displayed on the pocket 17, on a painting on a wall within the room, or as an object found within the room. Particular personalities may include a reader, with bookshelves filled with books being illustrated in the room; a sports fan, with selected sports equipment being illustrated; an artist, with paintings illustrated; or any other personality imaginable.

Figure 4:
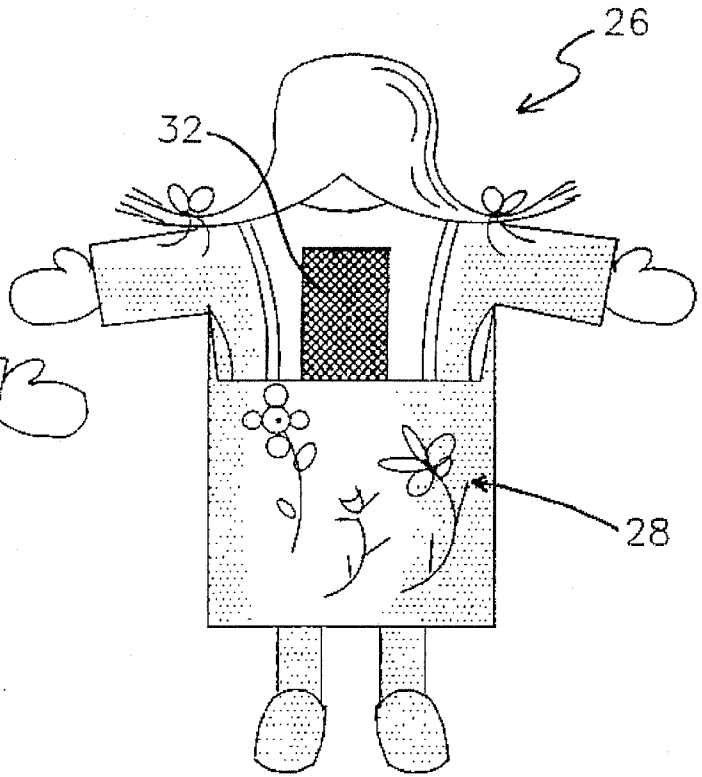
FIG. 4 is a back elevational view of the doll illustrated in FIG. 4.
Figure 3:
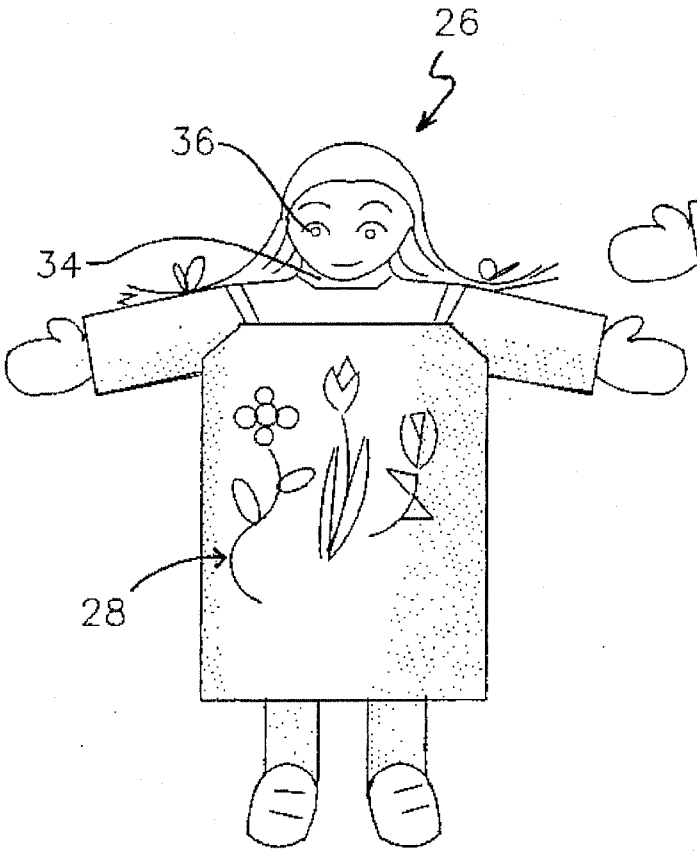
FIG. 3 is a front elevational view of a doll associated with the story quilt of the present invention.

FIGS. 3 and 4 illustrate the from and back views of a doll 26 of the present invention. The decorative design 28 illustrated on this doll's smock 30 is similar to that illustrated on the pocket 17 of the top center panel 16 illustrated in FIG. 1. Therefore, in this embodiment, the doll of FIGS. 3 and 4 is best suited for this panel 16. The personality of this doll 26 is indicative of a plant lover. Notice in the bottom right panel 16 illustrated in FIG. 1 that this doll 26 is shown gardening. As shown in FIG. 4, the cooperating portion 32 of the hook-and-loop fastener 18 is secured to the back of the doll 26.

Figure 5:
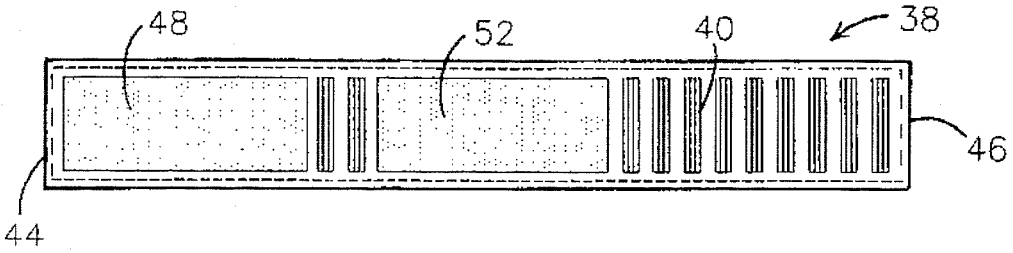
FIG. 5 is a top plan view of a wristband constructed in accordance with several features of the present invention.
Figure 6:
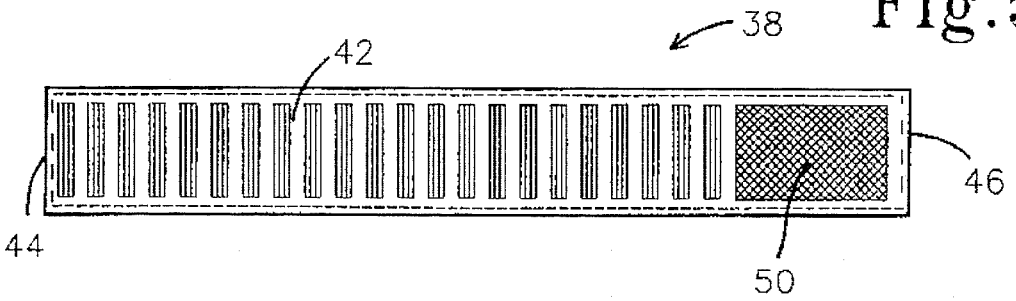
FIG. 6 is a bottom plan view of the wristband of FIG. 5.
Figure 7:
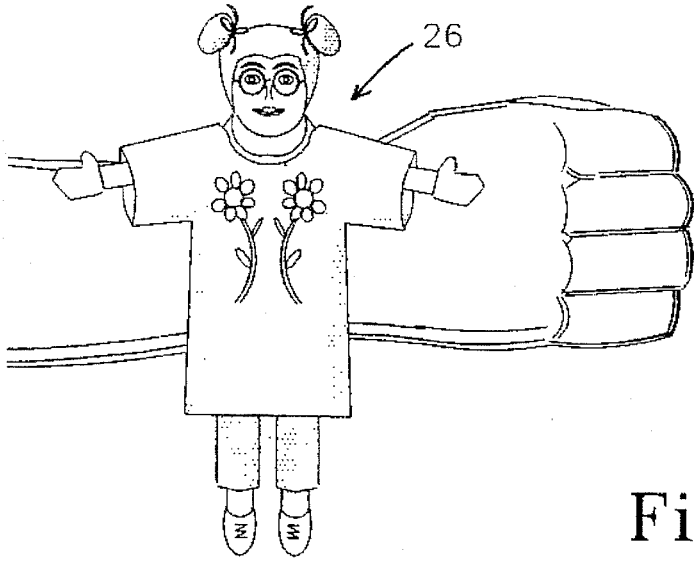
FIG. 7 illustrates the securement of a doll of the present invention being worn by a child using a wristband such as that illustrated in FIGS. 5 and 6.
Figure 8:
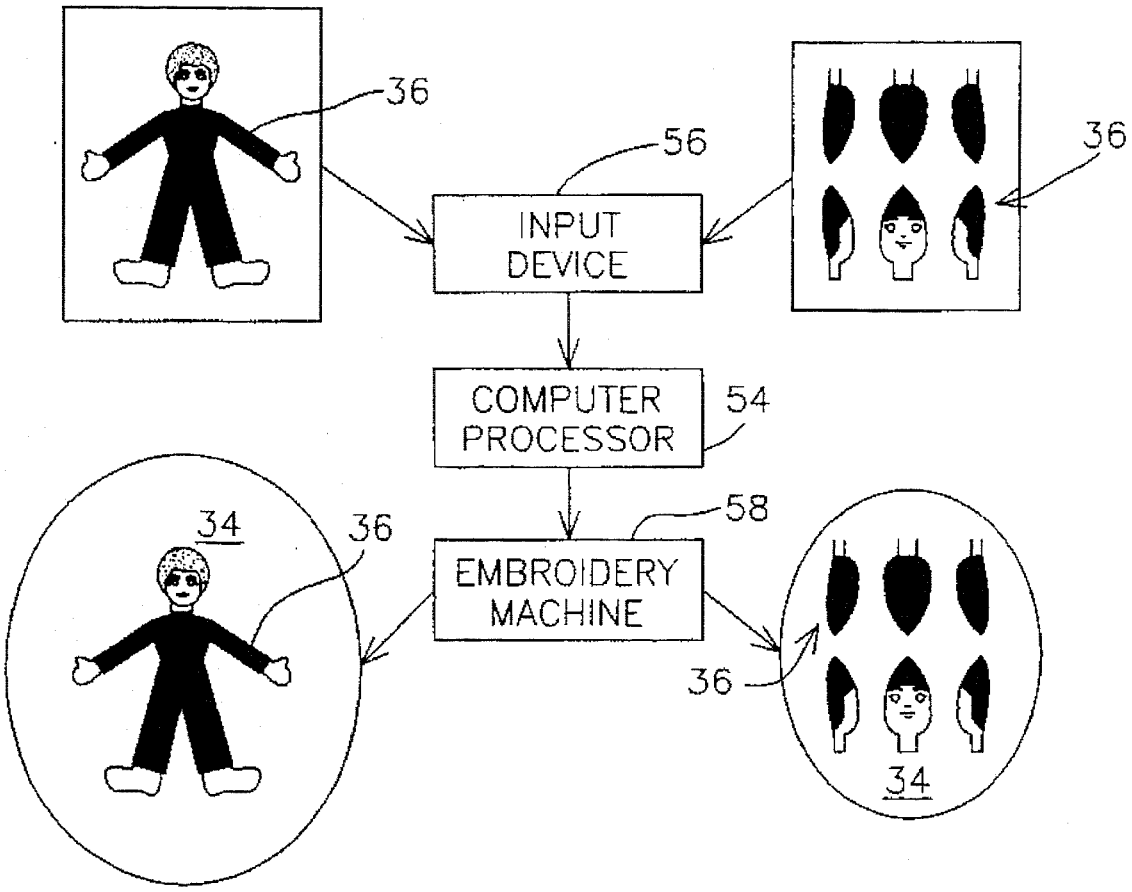
FIG. 8 is a schematic diagram illustrating the method of manufacture of the doll of the present invention.

Illustrated in FIGS. 5 and 6 are the front and back views of a wristband 38 provided for the securement of one of the dolls 26 of the present invention to a person's wrist or ankle. The wristband 38 is comprised of a length of elastomeric material such as a conventional elastic strip. One portion 48 of a hook-and-loop fastener is carried by the proximal end 44 of the top side 40 of the elastic strip while the cooperating portion 50 of the hook-and-loop fastener is carried by the distal end 46 of the bottom side 42 of the elastic strip. The cooperating portions 48,50 are thus engaged when the elastic strip is placed around a person's wrist or ankle. A portion 52 of a hook-and-loop fastener is further provided on the top side 40 of the elastic strip to cooperate with the portion of the fastener 32 carried by the doll 26. In the illustrated embodiment, a loop portion 52 is carried by the elastic strip for this purpose. Thus, it will be seen that the wristband 38 is securable to a child's wrist or ankle such that a doll 26 of the present invention may then be secured thereto and carried thereby. Such a disposal of a doll 26 of the present invention is illustrated in FIG. 7. It will be understood that other wristband 38 constructions may be used as well as the one illustrated and described. Further, it will be understood that a doll 26 of the present invention may be secured to other articles of clothing, such as caps or visors, shirts, pants, shoes, or any other such article. Therefore, the present invention is not intended to be limited to a wristband 38 as illustrated and described, or to the securement of a doll 26 to a wristband 38 in general.

The story quilt 12 and associated set of dolls 26 is provided for the entertainment of a child. Further, by associating a set of dolls 26 with a particular story quilt 12, it is intended that the creativity of the child be enhanced by encouraging the development of the child by providing a setting and a cast of characters. When acting out with the dolls 26, a child may move the dolls 26 from room to room, or may use the dolls 26 to interact with other toys. By providing a book 24 which portrays a story about the particular dolls 26 associated with the story quilt 12, a characterization of each of the dolls 26 may be initiated, thus causing further development of the child's imagination and creativity. Further, while the story is being read, the dolls 26 may be moved accordingly, or at least played with while they are specifically being discussed.

A further advantage to the story quilt 12 of the present invention is that it inhibits organizational skills. Specifically, each individual panel 16 is provided for the securement of one doll 26 thereto. Because each individual panel 16 is decorated specifically for one particular doll 26, the child not only has to place all of the dolls 26 on the story quilt 12, but is encouraged to place the dolls 26 in their appropriate rooms. Therefore, the child is encouraged to maintain the dolls 26 in an orderly fashion and learns that everything has its proper place.

The dolls 26 of the present invention are fabricated such that they may be safely used by children. To this extent, the dolls 26 are soft sculpture dolls 26 such that any impact with a child is substantially harmless. The faces and other features 36 of the dolls 26 and their apparel 30 are constructed using embroidery techniques controlled by a computer processor 54. Specifically, an artist rendered design 28,36 is input to a processor 54. The data input to the processor 54 is then manipulated by the processor 54 using appropriate software and is output to an automated embroidery machine 58. The embroidery machine 58 then stitches the design 28,36 onto a substrate 34. The substrate 34 is then cut as required and assembled. It is envisioned that the cutting of the substrate 34 may also be controlled via the processor 54 as a result of the input design 28,36, as well as the assembly of the doll 26, clothing 30, or other article to be embroidered.

The input of the design 28,36, in the preferred embodiment, is performed one color at a time. Specifically, a face and head 36 may be input in six layers if six thread colors are required. These layers may include: (1) the face, excluding the individual features; (2) the eyes excluding the pupils, (3) the pupils of the eyes, the eyelashes, and the eye brows; (4) the lips and nostrils; (5) the hair on the front of the head; and (6) the hair on the back of the head. The design 28,36 can be input in any conventional fashion such as by scanning, digitizing, or by simply creation within the computer via conventional graphics software. Once received within the processor 54, the data is stored for later retrieval as required. When the data is output to an embroidery machine 54, each of the layers are overlaid to compose the selected image 28,36. The design 28,36 may also be broken into several panels such that when assembled, a more detailed three-dimensional sculpture is created. For example, a head 36 may be segregated into three panels for the front and three panels for the back. Thus, when embroidered, cut out and assembled, the end result is a substantially human-shaped head.

From the foregoing description, it will be recognized by those skilled in the art that a story quilt and associated set of dolls offering advantages over the prior art has been provided. Specifically, the story quilt and associated set of dolls is provided for displaying and storing a set of dolls, the story quilt defining a story board having a plurality of scenes. Each doll is provided a particular scene in which they interact and are ultimately stored. The present invention also provides a means for carrying each individual doll in a manner that makes losing the dolls difficult. Further, the story quilt of the present invention is provided with a means for storing the carrying devices when not in use. The dolls of the present invention are fabricated from soft materials to create minimal risk to children playing with the story quilt of the present invention. Further, the dolls of the present invention are fabricated using embroidery techniques provided for achieving human or animal likenesses.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A story quilt and at least one soft sculpture doll associated therewith, said story quilt for being displayed on a wall and for telling a story in association with at least one said soft sculpture doll, said soft sculpture doll for emulating a living being, said story quilt comprising:

a quilted member fabricated from a quilted material having a front panel, said front panel defining a plurality of first individual panels and a second individual panel, wherein at least two of said plurality of said first individual panels is graphically illustrated to depict a scene, and wherein each said graphically illustrated first individual panel combines with each other said graphically illustrated first individual panels to illustrate the story;

a plurality of first pockets for storing items associated with said at least one soft sculpture doll, each of said plurality of first pockets being secured to one of said plurality of first panels;

a second pocket for closely receiving a book conveying the story, said second pocket being secured to said second individual panel; and a plurality of first fasteners, one each being carried by one each of said plurality of first individual panels for securement of one of said at least one soft sculpture doll thereto;

at least one soft sculpture doll comprising:

a body defining a configuration substantially similar to the living being;

at least one physical feature closely assimilating a corresponding feature of the living being; and a second fastener for securing said at least one soft sculpture doll to any one of said plurality of first fasteners carried by said story quilt.

2. The story quilt and at least one soft sculpture doll associated therewith of claim 1 wherein each of said plurality of first fasteners is one portion of a hook-and-loop fastener, and said second fastener is a cooperating portion of said hook-and-loop fastener.

3. The story quilt and at least one soft sculpture doll associated therewith of claim 1 wherein said physical feature is a human face and head.

4. The story quilt and at least one soft sculpture doll associated therewith of claim 1 further comprising a carrying device configured to be worn on a person.

5. The story quilt and at least one soft sculpture doll associated therewith of claim 4 wherein said carrying device is selected from a group of devices including at least: a strap worn about one of a person's extremities, a hat, a belt, a pair of suspenders, a shirt, a pair of pants, and a shoe.

6. The story quilt and at least one soft sculpture doll associated therewith of claim 4 wherein each of said plurality of first fasteners is one portion of a hook-and-loop fastener, and said second fastener is a cooperating portion of said hook-and-loop fastener, and wherein said carrying device includes one of said first fasteners for cooperating with said second fastener carried by said at least one soft sculpture doll.

7. The story quilt and at least one soft sculpture doll associated therewith of claim 1 wherein said at least one feature is embroidered upon said body of said soft sculpture doll.

* * * * *